US009724935B2

(12) United States Patent
Heath

(10) Patent No.: US 9,724,935 B2
(45) Date of Patent: Aug. 8, 2017

(54) GLOSS CONTROL THROUGH SELECTIVE DEPOSITION OF TRANSPARENT INK

(71) Applicant: Electronics for Imaging, Inc., Fremont, CA (US)

(72) Inventor: Peter Heath, Alexandria, NH (US)

(73) Assignee: ELECTRONICS FOR IMAGING, INC., Fremont, CA (US)

( * ) Notice: Subject to any disclaimer, the term of this patent is extended or adjusted under 35 U.S.C. 154(b) by 0 days.

(21) Appl. No.: 15/057,012

(22) Filed: Feb. 29, 2016

(65) Prior Publication Data

US 2016/0355030 A1 Dec. 8, 2016

Related U.S. Application Data

(62) Division of application No. 14/444,751, filed on Jul. 28, 2014, now Pat. No. 9,272,541.

(51) Int. Cl.

| | |
|---|---|
| ***B41J 11/00*** | (2006.01) |
| ***B41J 2/21*** | (2006.01) |
| ***B41M 5/00*** | (2006.01) |
| ***B41M 7/00*** | (2006.01) |

(52) U.S. Cl.

CPC ..... *B41J 11/0015* (2013.01); *B41J 2/2114* (2013.01); *B41M 5/0023* (2013.01); *B41M 7/0045* (2013.01); *B41J 2/211* (2013.01); *B41J 2/2117* (2013.01); *B41J 11/001* (2013.01)

(58) Field of Classification Search

None

See application file for complete search history.

(56) References Cited

U.S. PATENT DOCUMENTS

| | | | | |
|---|---|---|---|---|
| 3,259,515 | A | 7/1966 | Calman et al. | |
| 2009/0262159 | A1 | 10/2009 | Lang et al. | |
| 2011/0242556 | A1 | 10/2011 | Jinno et al. | |
| 2012/0050365 | A1 | 3/2012 | Konno et al. | |
| 2012/0276293 | A1* | 11/2012 | Hirakawa | B41J 2/2114 427/258 |
| 2012/0293574 | A1 | 11/2012 | Iu et al. | |
| 2013/0127960 | A1* | 5/2013 | Edwards | B41J 11/002 347/102 |

OTHER PUBLICATIONS

Merriam-Webster definition of Matte [retrieved on Oct. 28, 2016], Full Definition of Matte, definition b.*

* cited by examiner

*Primary Examiner* — Lisa M Solomon

(74) *Attorney, Agent, or Firm* — Perkins Coie LLP

(57) ABSTRACT

Embodiments of the invention take advantage of the change in gloss caused by overprinting a printed image with clear ink. Embodiments of the invention thus implement gloss control functionality in a printer without the requirements of a pin and cure or other known systems.

14 Claims, 10 Drawing Sheets

GLOSS CONTROL THROUGH SELECTIVE DEPOSITION OF TRANSPARENT INK

CROSS-REFERENCE TO RELATED APPLICATIONS

This application is a division of U.S. patent application Ser. No. 14/444,751, filed Jul. 28, 2014, which is incorporated herein in its entirety by this reference thereto.

FIELD

The invention relates to ink jet printing. More particularly, the invention relates to gloss control through selective deposition of transparent ink.

BACKGROUND

Various approaches are known with regard to controlling the glossiness of images printed using an ink jet printer.

Pin and Cure

A pin and cure system is known that allows adjustment of the gloss level of a printer's output. This helps a print shop tailor its products to its customer's needs. Such system consists of a set of adjustable UV LED pin lamps mounted inline with the printing area, and a set of larger mercury arc lamps after the print area. The adjustable nature of the LED lamps allows the ink to be set in place and the amount of flow to be controlled. Ink that is allowed to flow after being placed develops a smoother, glossier surface. Ink that is pinned harder does not flow and develops a more matte surface.

FIG. 1 is a graph that shows glossiness in gloss units vs. pin lamp levels in mW/cm. This behavior allows the printer operator to select the level of gloss for the printer output. This type of pinning relies heavily on the ink chemistry and its interaction with the substrate. Surface tensions of various media effect the amount of flow and the rate at which curing occurs. This, in turn, means that each media needs a specific configuration because the curve shown in FIG. 1 varies with media.

When the printer operator adjusts the pin and cure settings for various media, the chance of producing an unpredictable output having poor print quality is increased. Also, this process is time consuming as well as tedious. Because of the wide range of materials onto which an ink jet printer can print, it is possible to adjust the system so that the output is not acceptable, i.e. by introducing cure banding, as well as other print artifacts, such as ink bleed Other Methods Before pin and cure was available, there were already other methods of controlling the gloss on output from UV printers and other inkjet printers, such as LED printers, etc.

Printers manufactured by EFI, as well as those from other manufacturers, have always had the ability to adjust the UV lamp output. In this category of printer lower lamp output results in glossier prints. The drawback of this type of control is cure quality, adhesion, and surface feel suffer when the ink is not cured sufficiently.

Another method of gloss control involves adjusting the time-to-lamp. In a scanning printer it is usually possible to select a leading-lamp or post cure mode. This provides extra time from when the ink is jetted until it is cured, thus allowing drop spread and increased gloss. A significant problem with this approach is that time-to-lamp is affected by image width. Adding a delay between passes helps with uniformity, but impacts throughput.

Offset and screen printers address the issue of image gloss by allowing the printer operator to choose a gloss, semi-gloss, or matte ink.

Another option the printer operator has is during finishing. Printer output can be post coated or laminated. Some printers also offer a clear varnish internal to the machine. This type of printer is also suited to spot gloss.

Two-Pass Spot-Gloss

Some flat bed printers have a feature in which they offer spot-gloss without a clear ink. Their configurations allow the printer to print the entire image twice. First, the gloss areas are printed with their UV lamps at a low intensity. This allows for ink flow and a gloss surface. Then, the matte areas are printed, where the matte effect is accomplished by higher UV settings and less ink flow. The high cure over the already printed gloss areas insures a quality cure and no adhesion issues. However, a two-pass approach impacts throughput and can result in artifacts due to registration errors that occur as a result of the two-passes.

SUMMARY

Embodiments of the invention take advantage of the change in gloss caused by overprinting a printed image with clear ink. Embodiments of the invention thus implement gloss control functionality in a printer without the requirements of a pin and cure or other known systems.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DESCRIPTION

Embodiments of the invention take advantage of the change in gloss caused by overprinting a printed image with clear ink. Embodiments of the invention thus implement gloss control functionality in a printer without the requirements of a pin and cure or other known systems.

Gloss vs. Matte

The glossiness of a surface finish is effectively dictated by its surface roughness at a microscopic level. The smoother the surface, the glossier it appears. UV Ink drops are not absorbed into the media and do not evaporate, so they stand proud of the surface. This tendency lends itself toward rougher, more matte output. Allowing the ink to flow into a smoother surface provides for better gloss.

Clear Varnish

Figure 1:
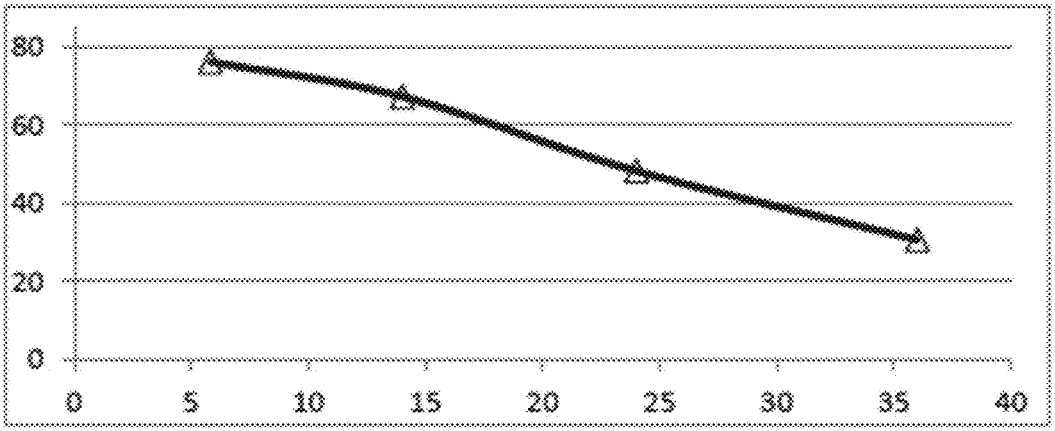
FIGURE 1 (PRIOR ART)
FIG. 1 is a graph that shows glossiness in gloss units vs. pin lamp levels in m W/cm.
Figure 2:
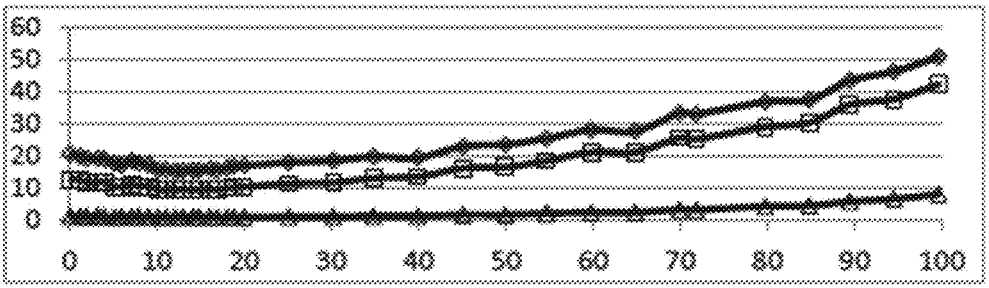
FIGURE 2 (PRIOR ART)
FIG. 2 is a graph that shows the effect of adding clear gloss ink to a matte printed image.

Traditionally clear ink or varnish has been applied at 100% coverage to increase the gloss of printed output. FIG. 2 is a graph that shows the effect of adding clear gloss ink to a matte printed image. As the clear ink smooths the surface, the image becomes glossier.

Clear Varnish for Matte

In accordance with embodiments of the invention, by randomly depositing a low percentage of clear drops onto a smooth surface and curing them quickly while they are tallest, the surface roughness increases and the glossiness of the image drops. In embodiments of the invention, this is accomplished using a random-number generator, e.g. available in a personal computer. In an example, take the image file size×percent, e.g. 48"×600 dpi×48"×360 dpi×12%=59,719,680, and add that many dots at random X and Y coordinates to the file to be printed.

In a production printer, a small image is created this way, e.g. 1" square, and the small image is applied by step-and-repeat over the whole image to save time. In embodiments of the invention, the percentage is determined, for example, per FIGS. 4 and 5. The ink drops can be cured, for example, for ⅛ to ½ second depending on the print mode using, for example, a 600 W/in Arc lamp or a 8 W/cm$^2$ UV LED. Smaller printers may use a different ink formulation and a 4 W/cm$^2$ UV LED.

Figure 3A:
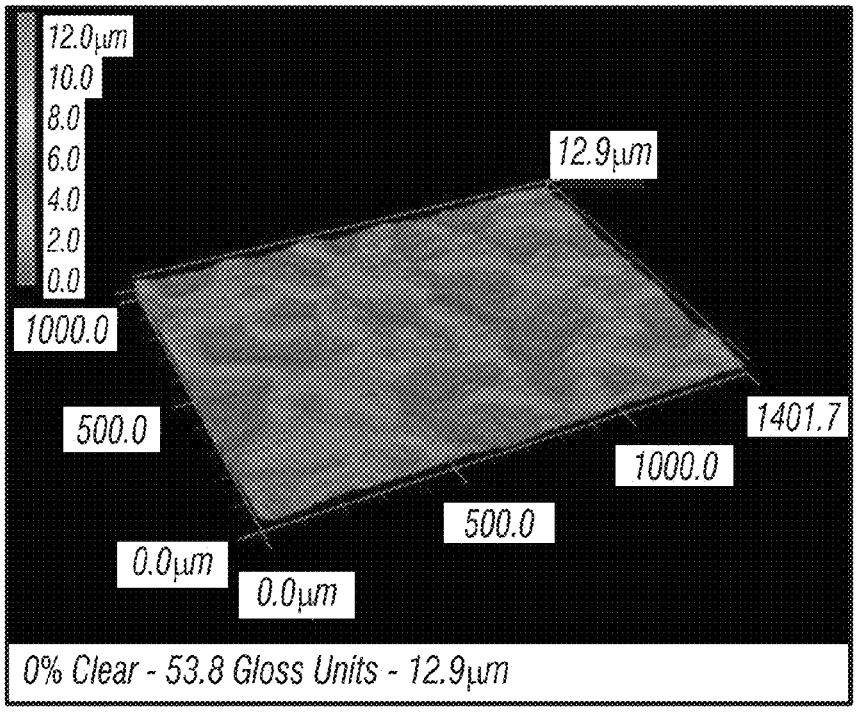
FIG. 3A (Prior Art)
FIGS. 3A and 3B are topological plots that show the ink drop profile for an image to which no clear ink is applied (FIG. 3A) and an image to which 25% clear ink is applied (FIG. 3B)
Figure 3B:
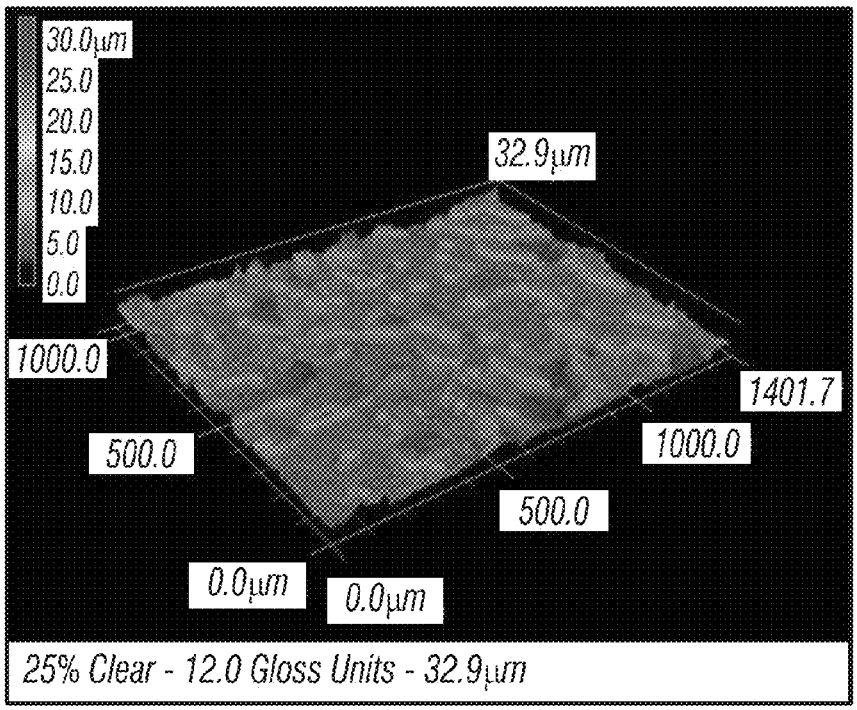

FIGS. 3A and 3B are topological plots that show the ink drop profile for an image to which no clear ink is applied (FIG. 3A) and an image to which 25% clear ink is applied (FIG. 3B). Note the prominent profile of the ink drops in FIG. 3B, which indicate that the image surface is rough and, therefore, more matte than the image of FIG. 3A, which has a smoother, and therefore glossier, surface.

Figure 4:
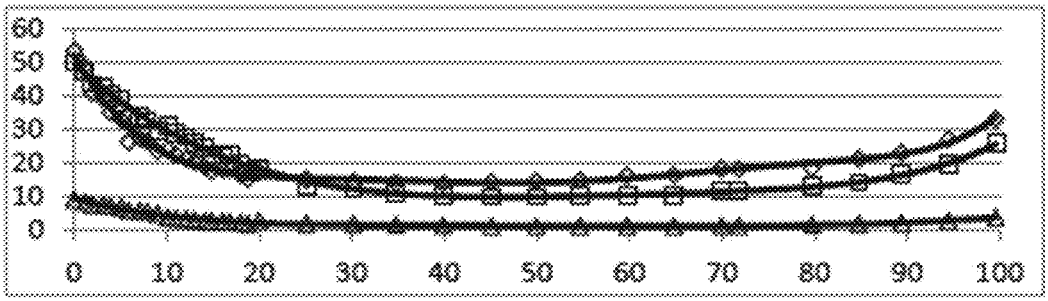
FIG. 4 is a graph that shows the correlation between percent clear coverage and gloss according to the invention.

FIG. 4 is a graph that shows the correlation between percent clear coverage (horizontal axis) and gloss (vertical axis). The plots in FIG. 4 show gloss units as different viewing angles. Triangles are at 20°, squares are at 60°, and diamonds are at 85°. Gloss units are on a 0-100 scale which represents the amount of light reflected by a surface at various angles. Here, a sample image printed at a normal gloss level of 53.3 (85°) is covered with varying amounts of clear ink, as shown along the X axis of the graph in FIG. 4. The value 53.3 indicates that when a light is shined onto the surface at 85°, i.e. 5° from straight vertical, about 53.3% of the light is reflected directly back to a sensor mounted 5° from vertical across from the light. The gloss level drops noticeably to below 14.9 with 25% clear coverage. As the clear starts to fill the surface, i.e. above 25% clear coverage, gloss levels return to near normal.

Gloss Control

Embodiments of the invention take advantage of the change in gloss caused by overprinting a printed image with clear ink. In embodiments of the invention, clear ink is applied equally to the image and to the portion of the print medium that is not covered by the image. This results in a print that has a uniform matte appearance. In other embodiments of the invention, clear ink may be selectively applied to portions of the image and/or to the image and portions of the print medium and/or to portions of both the medium and portions of the print medium as desired to provide distinctly matte and glossy areas on the print. In those embodiments of the invention where the image and medium are equally covered with clear ink, the ink may be jetted without regard to image information in accordance with a profile within the printer driver that controls ink deposition either to the extent desired for a particular level of gloss control, e.g. 25% coverage of the print, and/or ink deposition can be subject to stochastic masking, such that objectionable visible artifacts are not produced by deposition of the clear ink.

Figure 5:
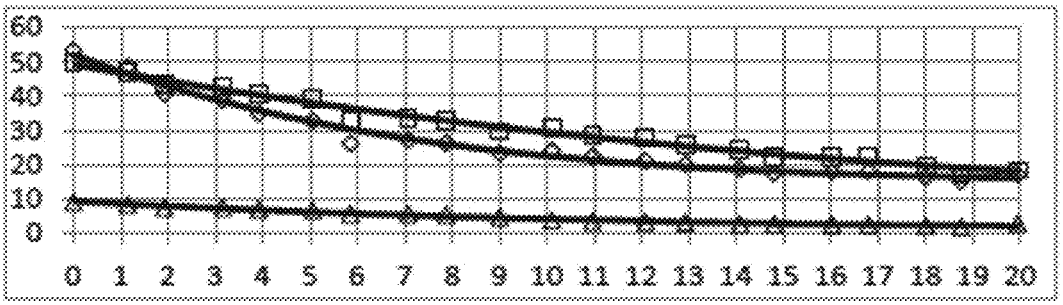
FIG. 5 is a crop of FIG. 4 that highlights the linear, predictable response of the gloss levels over the lower percentages of clear ink according to the invention.
Figure 6:
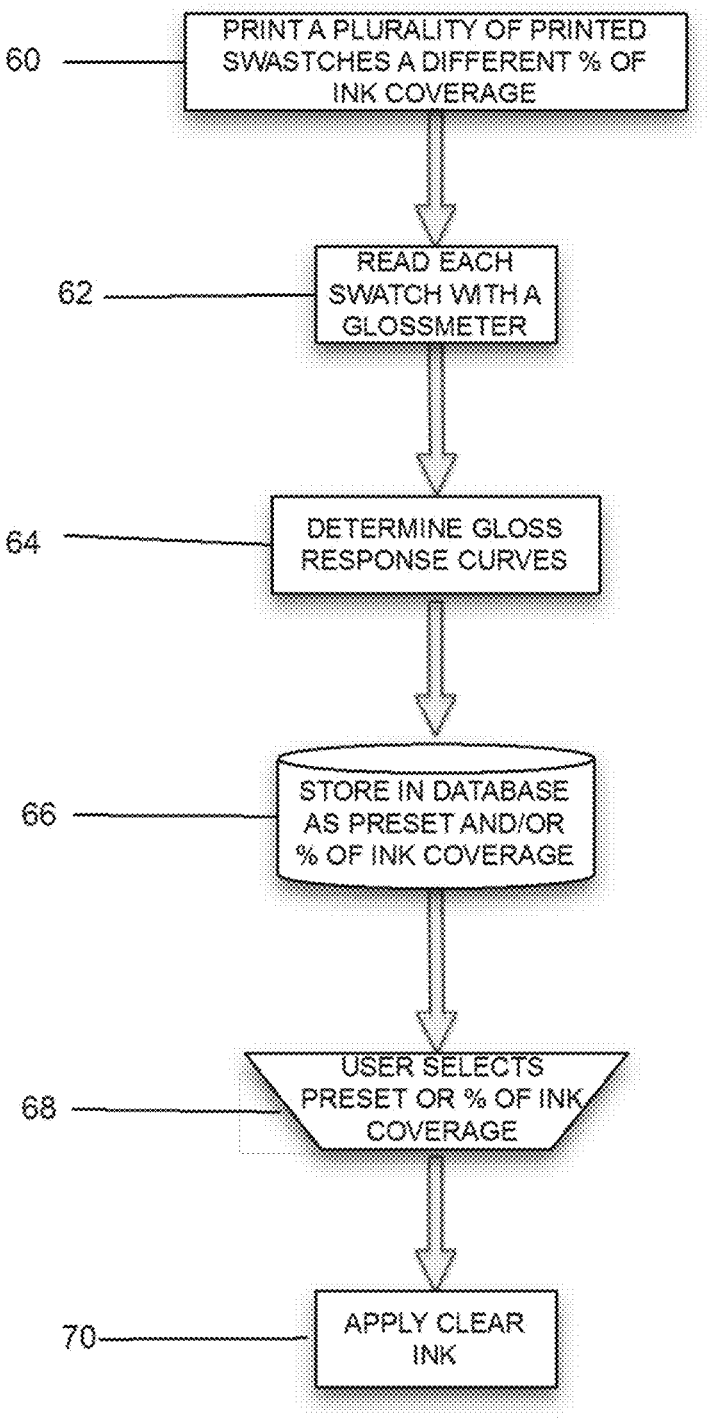
FIG. 6 is a flow diagram showing a method for establishing gloss response curves to control gloss according to the invention.

FIG. 5 is a crop of FIG. 4 that highlights the linear, predictable response of the gloss levels over the lower percentages of clear ink. This response curve is also easily measured. FIG. 6 is a flow diagram showing a method for establishing gloss response curves to control gloss according to the invention. Swatches of image are printed with varying amounts of clear on each swatch (60). Each swatch is then read with a gloss-meter or other imaging device that is used to measure gloss (62), that is either built into the printer or that is operated offline using a hand held or other external meter, e.g. a BYK-Gardner 4446 micro-TRI-gloss meter. Once the gloss response curves are known (64), they can be stored in the printer's media database (66). The curve shown in FIG. 4 is obtained by printing and measuring. This is the table that is stored into the database. In embodiments of the invention "Gloss" is 50, "Satin" is 25, and "Matte" is 20, although this is somewhat arbitrary. Once the curve, for example as in FIG. 4, is obtained the operator opens the media database and sets Gloss=0% Satin=9% and Matte=13%. This makes selecting between matte, satin, and gloss using known gloss units easy and predictable, as well as allowing custom settings of simple 0-100% (68). Once a selection is made, clear ink is applied to the entire medium (70), or clear ink can be applied selectively to the medium and/or image, as discussed above. This method of gloss control has less risk of bad output compared to a poorly configured pin and cure system, which can suffer from cure banding, wet banding, and spider-webbing.

Reduced Gloss Banding

Gloss banding is a phenomena that is common in inkjet printing, particularly with scanning carriage printers. It is a noticeable change in the glossiness of a band of print. Typically, this is an alternating pattern that has to do with the left-right/right-left nature of scanning printers.

Figure 7:
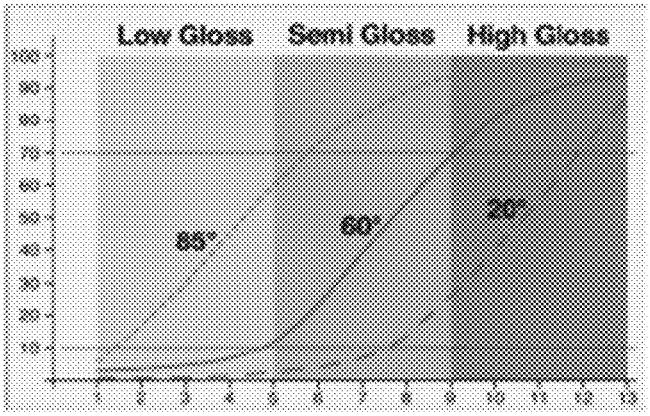
FIG. 7 shows the results of a case study where samples were visually ranked from matte to high gloss and measured with a gloss meter according to the invention.

FIG. 7 shows the results of a case study where samples were visually ranked from matte to high gloss and measured with a gloss meter. In the steep slopes of the curves, the differences between the samples can be clearly identified, while in the flat part, the measurement geometry no longer correlates with the visual. By making an image more matte in appearance, the differences in gloss levels between bands becomes less noticeable. These printers have a shuttling carriage that prints an image in small swaths. If all the swaths (passes) measure the same Gloss Units an observer sees a uniform image. Typically, in UV printers, the glossiness of each swath differs a little due to how the microscopic surface is built, e.g. travelling left-to-right vs. right-to-left, etc. FIG. 7 shows 13 samples printed in equal steps ranked by an observer. The observer has a harder time distinguishing matte samples and very glossy samples (flatter slope), but can easily distinguish (steeper slope) samples in the middle (through 50 Gloss Units). As shown in FIG. 4, UV printers normally print (0% gloss) around 50 gloss Units. This means that any deviation is easily noticeable; this is called gloss-banding. This is why UV printers that have a normally glossier output suffer from gloss banding issues more often than printers that have a normally matte output. By adding clear and making the image more matte, the goal is to move down to a flatter slope part of graph where an observer is less likely to notice deviation in gloss.

Media Independence

Solvent and water based printers produce a very thin ink film layer that makes such printers dependent on the substrate's gloss level. Printing UV ink onto a gloss substrate, and then adding a clear ink for matte, allows the image to have a much different gloss appearance than the native media it is printed on. In some embodiments of the invention, the application of clear ink over the entire surface of the medium provides a more uniform appearance to the resulting print because the same amount of matte effect is achieved on the those portions of the medium the are not covered by the image as those that are covered by the image.

As can be seen from the example in Table 1 below, when printed onto a fairly glossy PSA medium the output can still be very matte.

TABLE 1

| Media Independence | | | |
|---|---|---|---|
| | 20° | 60° | 85° |
| Media: | 24.2 | 55.3 | 77.6 |
| Print: | 9.9 | 48.4 | 53.7 |
| 25% Clr: | 1.8 | 13 | 14.9 |

Printer with Clear

Figure 8:
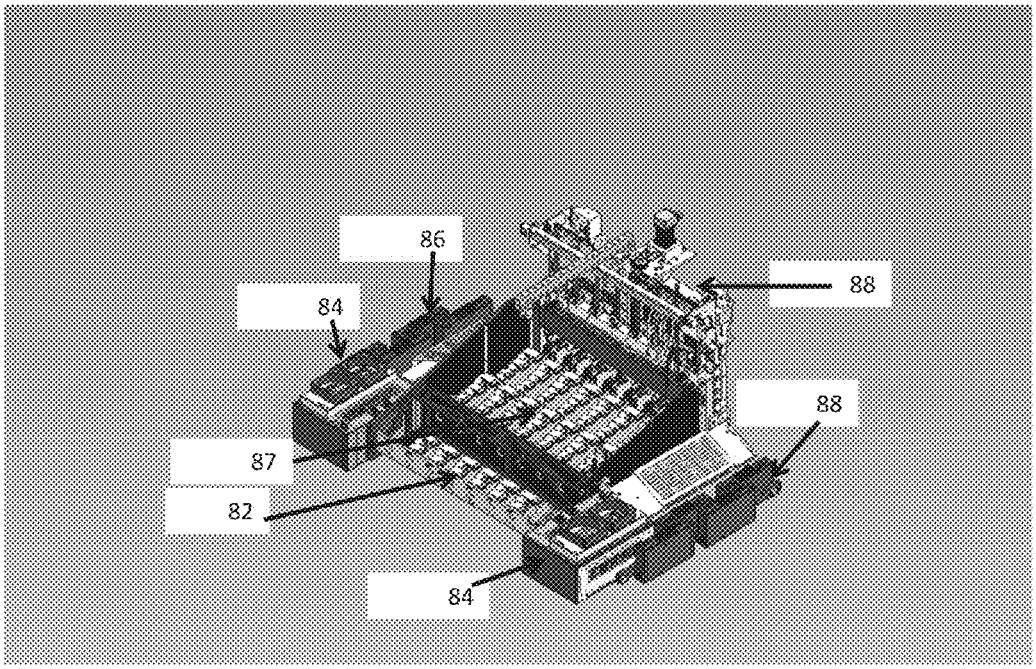
FIG. 8 is a perspective view of a printer that incorporates a clear ink printing system for gloss control according to the invention.

FIG. 8 is a perspective view of a printer that incorporates a clear ink printing system for gloss control according to the invention. In FIG. 8, a VUTEk HS100 Pro printer is shown as modified to support twelve clear print heads 82 that are installed between the UV cure lamps 84. These heads are mounted on an independent jet plate with their own pressurized ink delivery system and secondary ink tanks. The existing pin lamps 86 are adjusted so that the normal printed output is around 55 gloss units at 85° (about 200 mW/cm.). FIG. 8 also shows the color print heads 87 and printer control electronics 88. A clear UV ink derived from existing compatible colored inks can be used, if desired. In embodiments of the invention, for testing, a clear ink is made by not adding pigment to a UV ink formula; for production, a standard clear UV ink is used. Printing and measuring is accomplished quickly, as described above in connection with FIG. 6. Imaging and/or measuring devices can be incorporated into the printer design to allow creation of the gloss response curves within the printer itself.

User Interface

Figure 9:
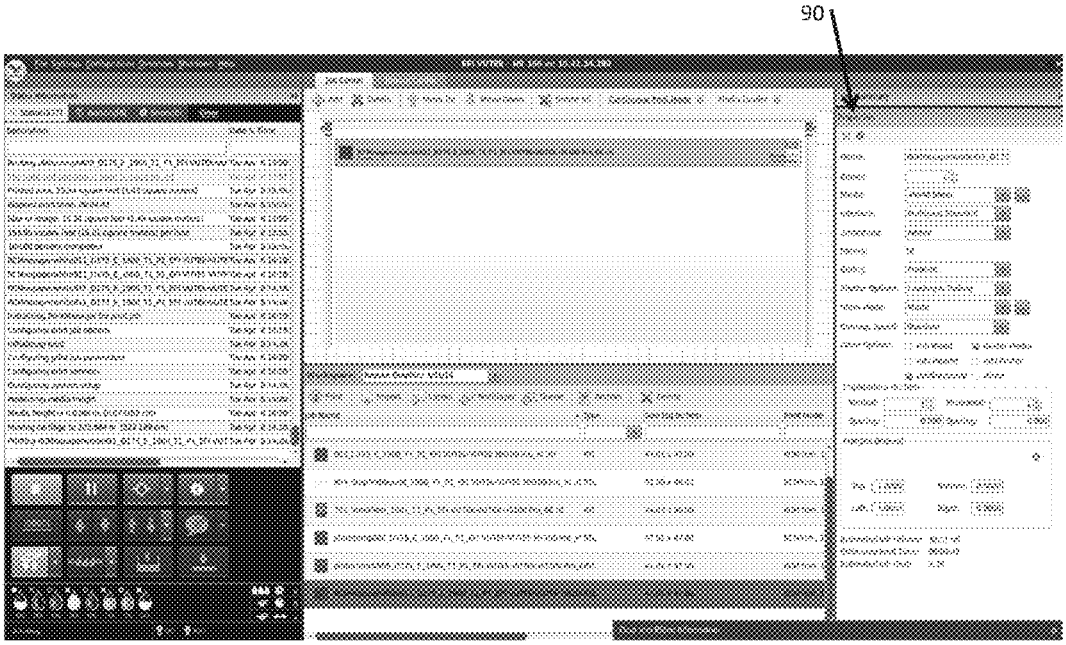
FIG. 9 is a screen shot showing the main screen of a printer user interface according to the invention.

FIG. 9 is a screen shot showing the main screen of a printer user interface according to the invention. On the right, in the properties pane 90, the operator selects the desired Gloss Mode, i.e. Matte, Satin, or Gloss. A gloss level control allows the operator to set custom values (0-100%). Those skilled in the art will appreciate that the user interface is readily implemented within the printer's control circuitry and, when operated, controls various action of the printer such as print head and nozzle operation, duration and quantity of ink deposition, cure times and energy levels, etc.

Media Database

Figure 10:
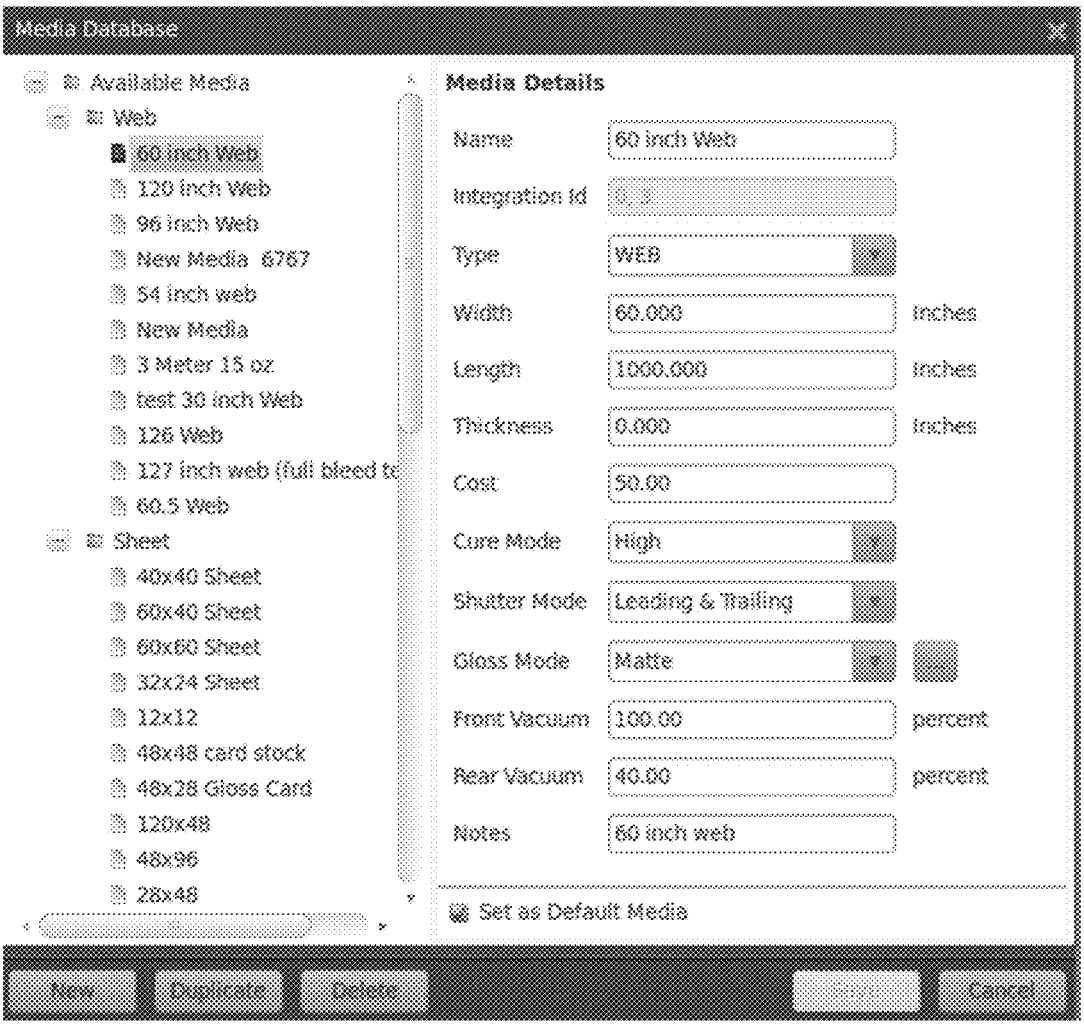
FIG. 10 is a screen shot showing the media database according to the invention.

FIG. 10 is a screen shot showing the media database according to the invention. In FIG. 10, the operator can set the default Gloss Mode, i.e. Matte, Satin, or Gloss. When the operator selects the gloss level control, the operator can enter the default values for Matte, Satin, and Gloss, e.g. Gloss=0% Satin=5% Matte=20%. In embodiments of the invention, the media database is a convenience feature of the system software that stores settings related to the various media onto which the printer can print. The first time an operator uses a media, it is entered into the media database with regard to size, cost, etc. To determine the gloss settings, the operator prints an image that has a series of gloss blocks made using various amounts of clear ink.

Typically, the operator measures these blocks, but he may just pick the values that he likes. For purposes of this discussion, assume that the operator measured all the blocks and came up with a curve such as that of FIG. 4. When the operator selects the gloss level control he is given choices for Matte, Gloss, and Satin. If the settings are Gloss=50, Satin=25, and Matte=20, then the operator picks values from the chart (see FIGS. 4 and 5) and enters, for example, 0% for Gloss, 9% for Satin, and 13% for Matte. The operator then saves these selections for this media.

When the time comes to print an image, the operator sees FIG. 9 on the screen. From here, the operator picks the media saved before, i.e. third down on Properties (90). Then the operator selects Gloss mode: he can choose from Gloss, Matte, Satin, and Custom. If he chooses Gloss, Satin, or Matte the values he saved are used. If the operator chooses Custom, a 0-100% value is entered.

Although the invention is described herein with reference to the preferred embodiment, one skilled in the art will readily appreciate that other applications may be substituted for those set forth herein without departing from the spirit and scope of the present invention. Accordingly, the invention should only be limited by the Claims included below.

The invention claimed is:

1. A method for gloss control, comprising:

receiving a user gloss control selection;

receiving a selection of a percentage of clear ink to apply to a printed image and/or print medium relative a gloss response curve to determine a value of gloss control, the selection based on the user gloss control selection; and in accordance with said selection, depositing small (0-25%) amounts of clear ink to said image and/or print medium to lower said image and/or print medium gloss level, wherein the image and/or print medium is more matte.

2. The method of claim 1, further comprising:

applying clear ink equally to said entire image and said print medium.

3. The method of claim 1, further comprising:

applying clear ink selectively to portions of any of said image and said print medium.

4. The method of claim 1, further comprising:

curing said ink immediately after deposition, while said ink is projected from a surface of said image and print medium.

5. The method of claim 1, said gloss control selection comprising any of a matte, satin, and gloss print.

6. The method of claim 1, said gloss control selection comprising a variable value gloss control.

7. A method for gloss control, comprising:

providing a gloss response curve relative to a percentage of clear ink applied to a printed image and/or print medium, said gloss response curve effecting control of said printer's print engine; and responsive to user selection of said gloss response curve, depositing small (0-25%) amounts of clear ink to said image and/or print medium to lower said image and/or print medium gloss level, wherein the image and/or print medium is more matte.

8. The method of claim 7, further comprising:

applying clear ink equally to said entire image and said print medium.

9. The method of claim 7, further comprising:

applying clear ink selectively to portions of any of said image and said print medium.

10. The method of claim 7, further comprising:

curing said ink immediately after deposition, while said ink is projected from a surface of said image and print medium.

11. The method of claim 7, further comprising:

receiving a user gloss control selection.

12. The method of claim 11, said gloss control selection comprising any of a matte, satin, and gloss print.

13. The method of claim 11, said gloss control selection comprising a variable value gloss control.

14. An apparatus, comprising:

a non-transitory storage medium containing information representing a gloss response curve for controlling a printer print engine to effect control of a percentage of clear ink to be applied to a printed image and/or print medium;

a control circuit configured to, responsive to user selection, use said gloss response curve to provide control signals to said printer print engine for depositing clear ink over said printed image and/or a print medium in accordance with said selection to effect selected control of glossiness of said printed image and/or said medium; and said control signals operating said printer print engine to deposit small (0-25%) amounts of clear ink to said image and/or print medium to lower said image and/or print medium gloss level, wherein the image and/or print medium is more matte.

* * * * *